US007306038B2

(12) United States Patent
Challacombe

(10) Patent No.: US 7,306,038 B2
(45) Date of Patent: Dec. 11, 2007

(54) WELL CLEANING METHOD AND APPARATUS USING DETONATING CORD HAVING ADDITIONAL RELIABILITY AND A LONGER SHELF LIFE

(76) Inventor: Bradley J. Challacombe, 2881 Blue Star St., Anaheim, CA (US) 92806

( * ) Notice: Subject to any disclaimer, the term of this patent is extended or adjusted under 35 U.S.C. 154(b) by 217 days.

(21) Appl. No.: 10/964,787

(22) Filed: Oct. 13, 2004

(65) Prior Publication Data

US 2006/0076131 A1 Apr. 13, 2006

(51) Int. Cl.
*E21B 37/00* (2006.01)

(52) U.S. Cl. ..... 166/299; 166/311; 166/63

(58) Field of Classification Search ..... 166/299, 166/311, 63; 102/317, 320
See application file for complete search history.

(56) References Cited

U.S. PATENT DOCUMENTS 2,100,807 A * 11/1937 Kinley ..... 166/63
2,136,881 A * 11/1938 Johnson ..... 166/302
2,362,829 A * 11/1944 Kinley ..... 102/313
2,414,349 A * 1/1947 Alexander ..... 166/299
3,721,297 A * 3/1973 Challacombe ..... 166/299
4,757,863 A 7/1988 Challacombe ..... 166/299
2004/0168805 A1* 9/2004 Fripp et al. ..... 166/297

* cited by examiner

*Primary Examiner*—David Bagnell
*Assistant Examiner*—Robert Fuller
(74) *Attorney, Agent, or Firm*—Steins & Associates, P.C.

(57) ABSTRACT

The Invention is a Well Cleaning Method and Apparatus using detonating cord having Additional Reliability and a Longer Shelf Life. The method and apparatus employs one or more subassemblies, each subassembly having a combustible material, means for igniting the combustible material, and one or more high-strength sleeves attached around portions of the combustible material to attenuate the outwardly-directed pressure wave created by ignition of the combustible material. The assemblies further exhibit staggered detonation with the simultaneous application of electrical current to all assemblies. The combustible material is further modified to add an additional outer impervious layer such that the combustible material exhibits prolonged shelf life and durability.

18 Claims, 5 Drawing Sheets

WELL CLEANING METHOD AND APPARATUS USING DETONATING CORD HAVING ADDITIONAL RELIABILITY AND A LONGER SHELF LIFE

BACKGROUND OF THE INVENTION

1. Field of the Invention

This invention relates generally to water well apparatus and, more specifically, to a Well Cleaning Method and Apparatus using detonating cord having Additional Reliability and a Longer Shelf Life.

2. Description of Related Art

The present invention is an improvement on U.S. Pat. No. 3,721,297 for Method for Cleaning Wells, and on U.S. Pat. No. 4,757,863 for Well Cleaning Method and Apparatus. The '863 patent sought to, and in fact did, resolve several problems associated with the design of the '297 patent. The method and apparatus disclosed by the '863 patent utilized a design that was less costly and less complex than that disclosed in the '297 patent. Furthermore, the device of the '863 patent is compliant with government transportation regulations that prohibit the shipping of armed explosives. As a result of these improvements, the new device met with continuing and widespread success.

Despite the sustained success of the revised device, as additional experience has been gained with the device and method of the '863 patent, other deficiencies have been recognized. First, it has become desirable to extend the shelf life of the device, so that long periods of storage (either at the supplier or end-point user) will not make the device unreliable. Second, there has been some evidence of non-sequential detonation in adjacent explosive assemblies; while this is not a safety problem, it can reduce the overall effectiveness of the method and device.

What is needed, therefore, is an improved well cleaning apparatus that has a longer shelf life and more reliably sequential detonation.

SUMMARY OF THE INVENTION

In light of the aforementioned problems associated with the prior devices and methods, it is an object of the present invention to provide a Well Cleaning Method and Apparatus using detonating cord having Additional Reliability and a Longer Shelf Life. The method and apparatus should employ one or more subassembly, each subassembly having a combustible material, means for igniting the combustible material, and one or more high-strength sleeves attached around portions of the combustible material to attenuate the outwardly-directed pressure wave created by ignition of the combustible material. The assemblies should exhibit staggered detonation with the simultaneous application of electrical current to all assemblies. The combustible material should further be modified to add an additional outer impervious layer such that the combustible material exhibits prolonged shelf life and durability.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Well Cleaning Method and Apparatus using detonating cord having Additional Reliability and a Longer Shelf Life.

As discussed in the '863 patent, the method and apparatus of a preferred embodiment of the present invention employs a simplified, inexpensive apparatus to create a harmonic wave of radially-outwardly-directed gas pressure within a section of well casing. When created under the current method, the gas pressure wave will travel longitudinally along the length of the casing, thereby cleaning plugged perforations in the casing.

If standard, unmodified detonator cord is used for this application, the power necessary to clean the casing will also be sufficient to cause severe damage to the casing, particularly when the well is aged. Consequently, the method and apparatus of the present invention modifies the pressure wave so as to provide staged, omni-directional, repetitive harmonic gas pressure releases. Specifically, as the pressure wave travels along the length of the casing (or that portion being treated), the explosive force is restricted at various locations along its length by high strength restrictor sleeves. The result is a plurality of pressure impulses along the length of the casing.

Furthermore, the apparatus is divided into sub-assemblies which are detonated sequentially, further staggering the generated pressure waves. Having summarized the operation of the present invention, we shall now turn to FIG. 1 to examine the improvements in additional detail.

Figure 1:
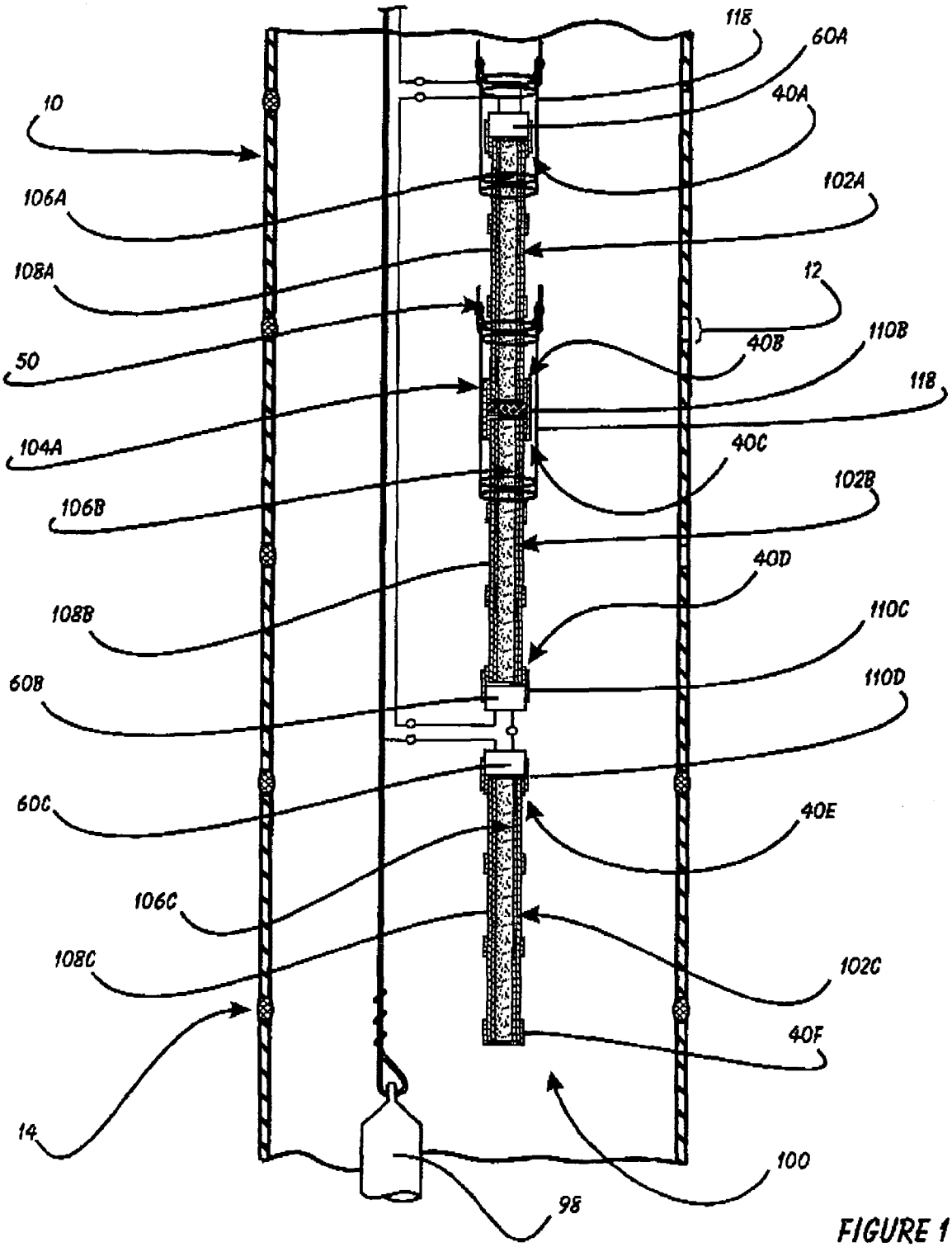
FIG. 1 is a partial cutaway side view of the assembly of the present invention inserted into a well.

FIG. 1 is a partial cutaway side view of the assembly 100 of the present invention inserted into a well. In the interest of clarity, many of the elements of the present invention are essentially the same as those disclosed in the '863 patent discussed above. In order to highlight the differences between that prior design and that of the present invention, elements that are added or modified in this disclosure begin with the number 100 and extend upward from there.

As depicted, the assembly 100 comprises three sub-assemblies; two of the three of these are numbered separately in FIGS. 2 and 3, below. In operation, the assembly 100 is inserted into a well casing 10 by being attached to a cable and weight 98, and then lowered down. The casing 10 is defined by a tubular wall containing a plurality of perforations or apertures 12 along its length. As the well ages, obstructions 14 tend to collect or otherwise form in the perforations 12, leading to plugging; when a sufficient number of the perforations 12 become clogged, the well's specific capacity is reduced (i.e. it's water production volume). Until the evolution of this invention and its predecessors, the well had to be replaced or re-perforated; now, it can simply be cleaned by creating a specialized pressure wave that forces the obstructions 14 out of the perforations 12, without damaging the casing 10.

Each sub-assembly (see FIG. 2) is formed of insulated flexible tubing sections 102A, 102B and 102C, having (for example) polyvinyl chloride filled with a combustible material having a selected rate of deflagration. As in the '863 patent, it is still preferred to employ a standard detonating explosive known as PETN (Pentaerythiritol Tetranitrate or Pentaerythrite Tetranitrate). In one preferred form, the outside diameter of the tubing sections 102 is approximately between 0.21 and 0.22 inches in diameter and the tubing has an inside diameter sufficient to provide a desired number of grains of explosive, such as for example 20, 30 or 40 or more grains per foot of length, depending upon the amount of power desired.

Unlike the tubing in the '863 patent, the tubing sections 102 in the present invention are modified to include a second PVC coating (or other compatible material). As a result, the tubing 102 has an inner sheath 106A, 106B and 106C, as well as a second outer sheath 108A, 108B and 108C. This second PVC coating provides added water-proofing characteristics, while further modulating the explosive force at any given point along the entire length of the tubing 102. Because the tubing 102 is being lowered into a water-filled well casing 10, in the past, it was possible for a slight nick in the tubing 102 to allow water to seep into and damage the combustible material; the second layer of PVC extruded over the tubing 102 makes the tubing 102 substantially more durable to inhibit such damage. The addition of the second outer sheath adds approximately 0.02 inches to the outer diameter of the tubing sections 102.

Similar to the design of the '863 patent, each section of tubing 102 has a plurality of restrictor sleeves 50 encircling it at spaced-apart intervals. These high strength steel "girdles" are crimped onto the flexible tubes 102 in order to hold them in place. As in the '863 patent, the spacing intervals of the sleeves 50 is between two and one-half and twenty-one feet, depending upon the length of each tube section 102. The sleeves 50 are made of a drawn seamless mild steel tubing, having a wall thickness in the range of about 1/32 to 1/4 inches. As in the '863 patent, each sleeve 50 has a length of about four inches.

The ends of each tubing section 102 is covered and sealed by end covers 40; the design and installation method of these covers 40 will be discussed more fully below in connection with FIG. 3. Each tubing section 102 further has a detonator cap 60A, 60B and 60C attached to one said end cover 40, and crimped in place with a connecting sleeve 110A, 110C and 110D, respectively. Just as in the design of the '863 patent, two of the tubing sections (102A and 102B here) are connected end-to-end, with their respective detonator caps 60 at their respective opposite end.

A particular difference between this design and that of the previous designs is the addition of a dampener element 104A between the end covers 40B and 40C; the purpose of this new element will be discussed more fully below in connection with FIG. 3. The dampener element 104A and two ends of the tubes 102A and 102B are held together by a connecting sleeve 110B. Alternatively, the dampener element 104A could be held in place with durable tape or other material. The dampener element 104A serves to delay or prevent the detonation from one tube 102A from causing sympathetic or cross detonation in the adjacent tube 102B (or vice versa, depending upon the order of initiation). By isolating the detonation of the two tubes 102A and 102B from one another, the reliability and explosive effectiveness are enhanced over the prior systems.

The balance of the elements and functionality of the assembly 100 are substantially as described in the '863 patent. Leads at the triggering end of detonator cap 60B are connected to the other caps 60, namely, one is connected to a corresponding electrical lead at the closely adjacent triggering end of detonator cap 60C, and one is connected to the corresponding location on the detonator cap 60A. The remaining lead from the detonator cap 60C is connected to ground (such as by connection to the suspension cable); the remaining lead from the detonator cap 60A is connected to a switchable power source, such that adding power to this lead will cause the caps 60 to detonate.

The cable, electrical leads and the assembly 100 are all connected together by suitable means, such as by wrapping tape around the group for the full length thereof, thus securely coupling the assembly 100 to the suspending cable. As with the '863 patent, for the purpose of safety in handling and transport, the detonator caps are not electrically or physically connected until the assembly 100 is ready to be lowered into a well casing (i.e. not during shipping or storage).

To manufacture the assembly 100, the tubes 102 are first double-extruded (or more layers, if desirable) and cut to the desired length. The restrictor sleeves 50 are then placed in their proper longitudinal positions and crimped in place. Next, the sealing end covers 40 and tube ends are treated with a non-drying sealant material, such as petroleum jelly. This sealing material has proven to further prevent water leakage into the combustible material.

Once the covers 40 are inserted over the tube ends, they are crimped in place twice. The second crimp provides still further additional waterproofing characteristics to the assembly 100 to prevent moisture damage due to immersion and/or long-term storage. Next, the tube sections 102 are secured to the cable and wire by spiral tape, leaving adjacent ends of the tubes 102 free for subsequent connection of the detonator caps 60.

The detonator caps 60 are prepared for handling, storing and transport by securing the connecting sleeves 110 thereto, leaving the free projecting ends of the sleeves 110 open for future connection to the assembly 100 and grounding the detonator caps' 60 two leg wires. The detonator caps 60 and assembly 100 are transported in separate "four G" shipping containers and stored in separate "type two" magazines.

Figure 2:
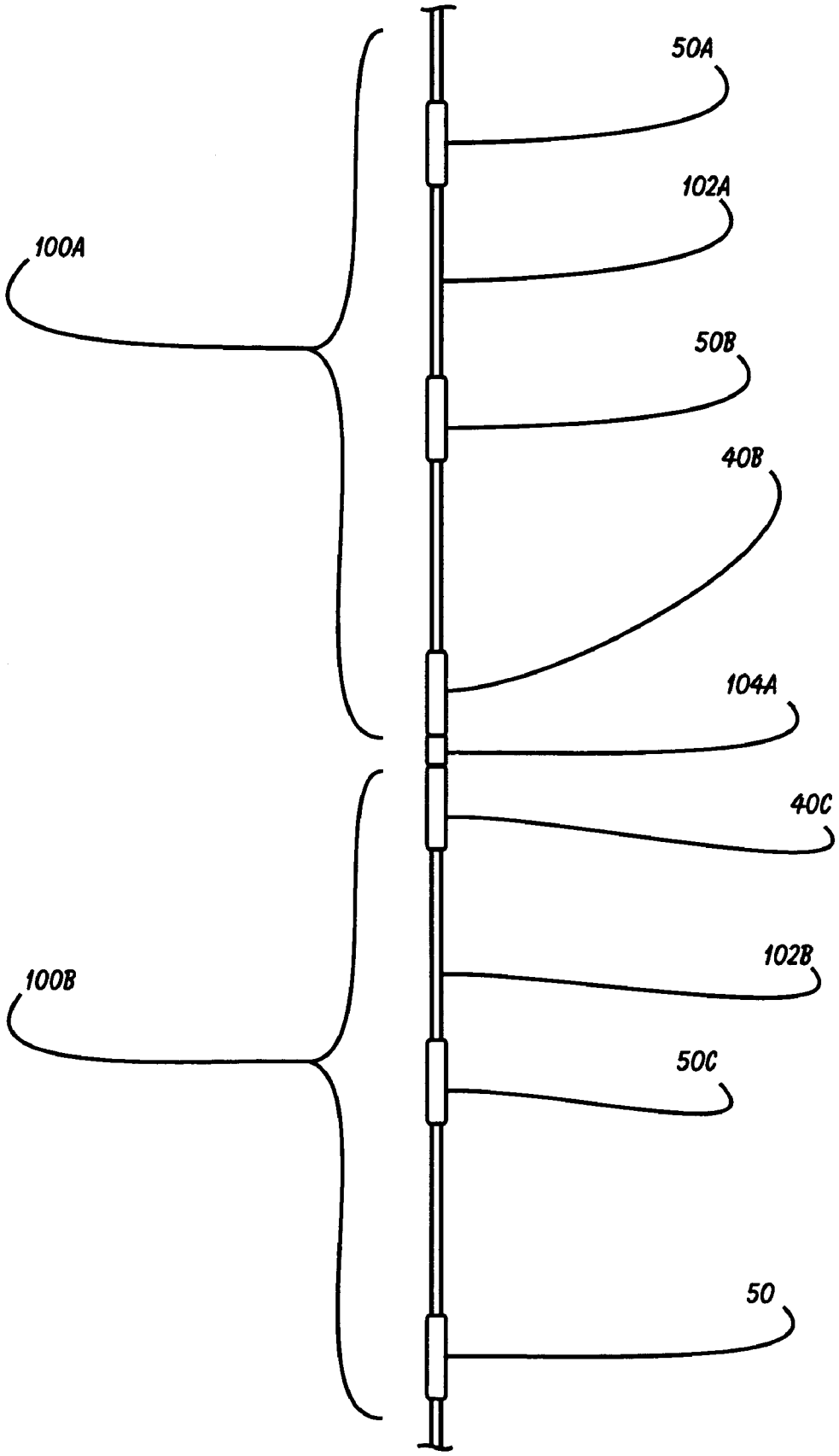
FIG. 2 is a partial side view of the assembly of FIG. 1.

For installation and operation in a to-be-cleaned well, the detonator caps 60 are assembled in the field, with the arming of the assembly 100 occurring just prior to use, in the arrangement shown in FIGS. 1 and 2. After assembly of the three sub-assemblies, the assembly 100 is lowered into the casing 10 by cable until it resides in an area to be cleaned. Electrical power is applied to the cable and electrical activation of the detonator caps 60 occurs simultaneously; the delay times chosen for each specific cap 60, aided by the dampener element 104A, will provide sequential ignition of the tubes of combustible material in a selected sequence.

The detonation of the assembly 100 is essentially the same as discussed at length in the '863 patent, with the additional protective buffer provided by the dampening element 104A to insure that one tube 102 is not sympathetically- or cross-detonated by another tube 102.

FIG. 2 is a partial side view of the assembly 100 of FIG. 1. As shown here, each set of tube 102, restrictor sleeves 50 and end covers 40 are referred to as modified pressure wave generator sub-assemblies 100A and 100B (100C is not depicted). As should be apparent, the spacing of the sleeves 50 and end covers 40 (and therefore detonator caps) is variable and depends upon the geometry of the to-be-cleaned section of the well casing. Finally turning to FIG. 3, we can examine three of the unique modifications to the '863 design in more detail.

Figure 3:
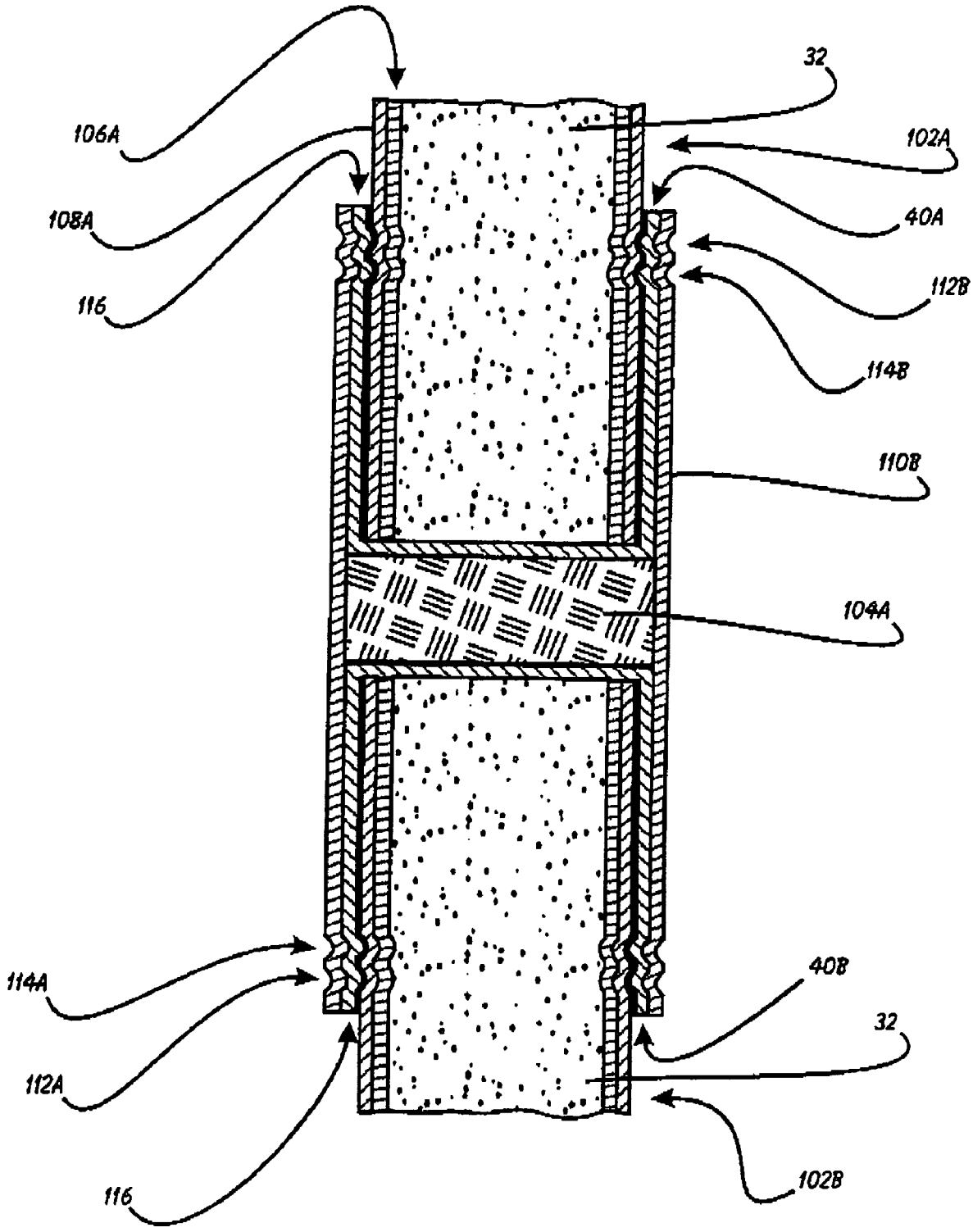
FIG. 3 is a partial cutaway side view of the intersection between the first and second assemblies depicted in FIGS. 1 and 2.

FIG. 3 is a partial cutaway side view of the intersection between the first and second assemblies 100A and 100B depicted in FIGS. 1 and 2. As shown, the combustible material 32 is contained within a first layer of extruded PVC, namely, the inner sheath 106. This inner sheath 106 is then further surrounded by an outer sheath 108 of PVC. It may be desirable in other embodiments that additional sheaths may be provided, and further that other materials having different properties may be used.

Prior to inserting the end of the tube 102 into an end cover 40, the tube 102 and/or inner surface of the cover 40 is coated with a suitable non-drying sealant material 116. In this example, petroleum jelly has been used, but in other versions, different products may be utilized. The sealant 116 is preferably non-drying to prevent the water-tight seal from degrading over time, particularly when the assembly 100 is in storage for prolonged periods. Prior to the addition of this sealant 116, there was some propensity for a leak to develop in the assembly 100 while in shipping or storage, only to reveal itself once the assembly 100 was immersed in a well casing for use. Since adding the sealant, it has been observed that fewer misfires occur due to liquid penetration into the combustible material 32; this translates into substantially longer shelf lives without compromising the reliability of the system.

Once the end covers 40 and connecting sleeves 110 are assembled, they are now held in place by an end crimp 112 as well as an intermediate crimp 114. Adding a second crimp to the prior design has further added additional reliability in the watertight seal created between the tube 102, the cover 40 and the connecting sleeve 110, without necessitating additional sealing material or modification of the unassembled parts used in the assemblies 100.

Figure 4:
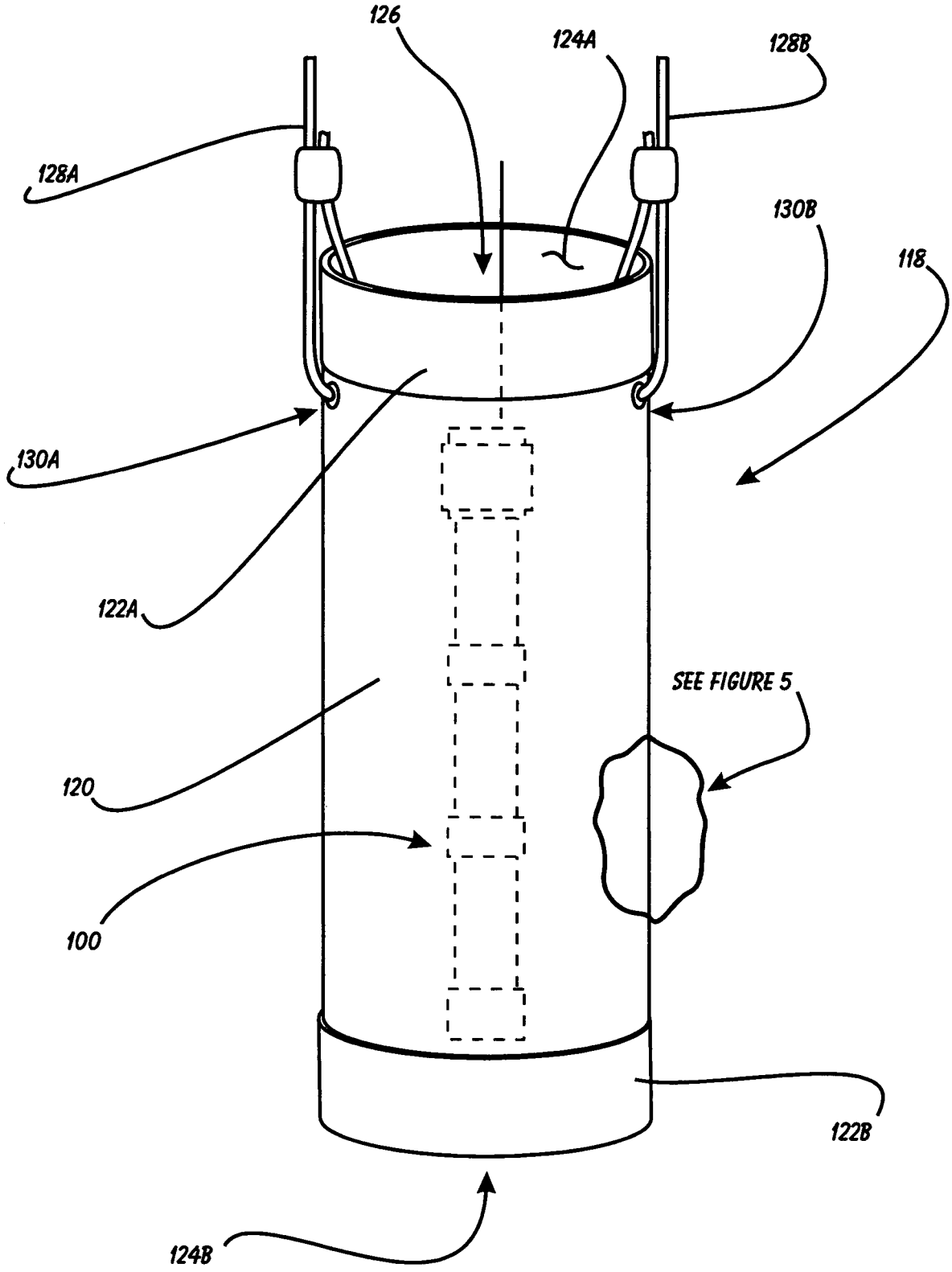
FIG. 4 is a side perspective view of an explosion shield of the present invention.

Also depicted here is the dampener element 104A. As discussed above, the element 104A is inserted between the first and second sub-assemblies 100A and 100B, respectively, to prevent the sympathetic or cross detonation of one tube by another tube prematurely. In this embodiment, the element 104A is a wooden spacer that is inserted between the sub-assemblies 100A and 1001B prior to their final assembly. The element 104A is held in place either by the connecting sleeve 110B, as shown, or it might be held there by wrapping with the same tape used to secure the assembly 100 to the cable and wires (see FIG. 1). In other versions, the element might be made from some other non-explosive material that provides adequate sacrificial power-absorbing traits. Turning to FIG. 4, we can examine another novel and nonobvious improvement of the present invention.

FIG. 4 is a side perspective view of an explosion shield 118 of the present invention. The shield 118 comprises a generally cylindrically shaped wall 120 having retainer rings 122A and 122B at each end. The wall 120 is preferably made from stainless steel screen material. The rings 122 are preferably made from hardened steel approximately 0.75 inches wide and approximately 0.20 inches in thickness. The retaining rings 122 cause the screen material to stay in its cylindrical shape.

Figure 5:
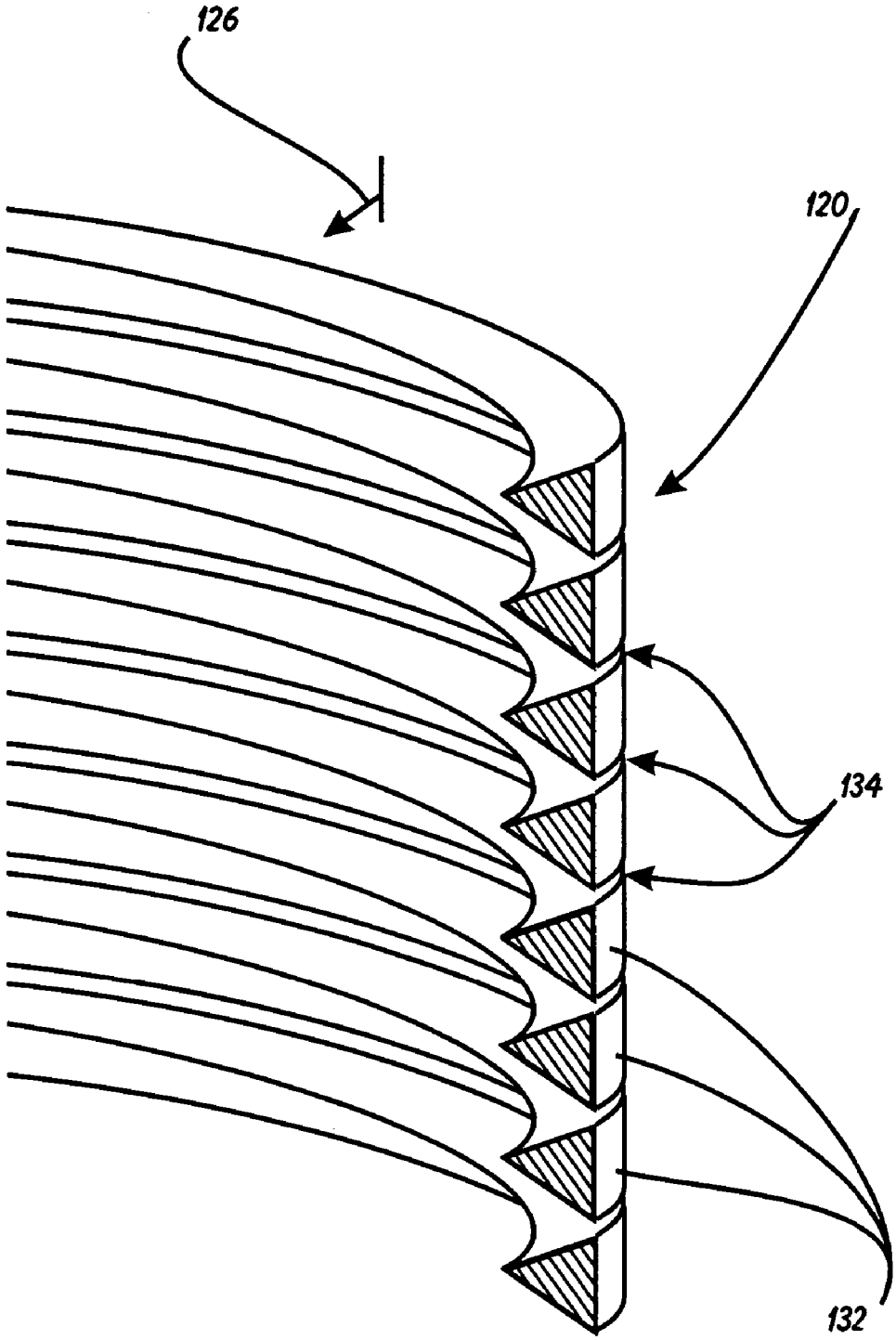
FIG. 5 is a partial cutaway side view of a portion of the shield of FIG. 4.

FIG. 5 is a partial cutaway side view of a portion of the shield of FIG. 4. In this view, the wall 120 of the shield 118 (see FIG. 4) is shown in more detail. The wall 120 is made of a series of filaments 132 in spaced relation with slots 134 between each filament 132 (i.e. the aforementioned "screen material"). The wall 120 of filaments 132 defines an inner chamber 126 within the cylindrical shield 118 (see FIG. 4).

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Well cleaning apparatus for a liquid well having a casing comprising:

first and second subassemblies, each said subassembly comprising:

an elongated tube of substantially uniform cross section containing combustible material having a deflagration rate many times greater than the velocity of sound in the liquid of the well;

means for igniting said combustible material to achieve deflagration of said material that progresses along the length of said tube and generates outwardly directed pressure;

a plurality of short high strength sleeves mutually spaced by distances many times greater than the length of said sleeves secured to the exterior of said tube for attenuating said outwardly directed pressure at short areas spaced along the length of said tube by relatively long distances;

a dampening element positioned between and in axial alignment with said first and second subassemblies; and means for holding said tube in the casing of the well.

2. The apparatus of claim 1, further comprising:

a third said subassembly.

3. The apparatus of claim 2, wherein said means for igniting comprises first, second and third electrically activated detonator caps, each connected to a respective one of said tubes at an end of said tube, each said detonator cap having a different amount of delay, whereby upon simultaneous electrical activation of all three said detonator caps, said combustible material in one said tube is ignited first, said combustible material of said second said tube is ignited after said first ignition, and said combustible material of said third tube is ignited after said first and second ignitions.

4. The apparatus of claim 2, wherein each said tube comprises an inner sheath and an outer sheath, said inner sheath containing said combustible material.

5. The apparatus of claim 2, wherein:

each said tube is further defined by a pair of opposing ends, one said end having an end cover attached thereto; and further comprising a non-drying coating of non-dried sealant between said ends and said end covers thereattached.

6. The apparatus of claim 5, wherein said end covers and said tubes thereattached are defined by a pair of circumferentially crimped indentations.

7. The apparatus of claim 1, wherein each said tube comprises an inner sheath and an outer sheath, said inner sheath containing said combustible material.

8. The apparatus of claim 1, wherein:

each said tube is further defined by a pair of opposing ends, one said end having an end cover attached thereto; and p1 further comprising a non-dried coating of non-drying sealant between said ends and said end covers thereattached.

9. The apparatus of claim 8, wherein said end covers and said tubes thereattached are defined by a pair of circumferentially crimped indentations.

10. The apparatus of claim 1, further comprising tubular blast shields, one said subassembly passing through an inner chamber defined by each said blast shield, said blast shield comprising a plurality of filaments in spaced relation along their length.

11. A method of cleaning the casing of a fluid well comprising the steps of:

providing first, second and third tubes of detonator cord having a substantially uniform cross section filled with combustible material, each said cord further defined by an inner sheath and an outer sheath;

forming a suspending cable and an electrically conductive wire extending along the length thereof;

forming first and second pairs of series connection terminals on said wire at first and second mutually spaced electric connection points along said cable;

positioning a plurality of short mutually spaced high strength sleeves on each of said first, second and third tubes at positions mutually spaced along the length of said tubes by a distance greater than the length of said sleeves;

sealing the ends of each of said tubes;

securing said tubes in end to end relation to said cable and electrical wire with adjacent ends of said first and second tubes spaced apart by a selected distance near said first electric connection point of said cable and the remote end of said third tube positioned near said second electric connection point;

securing a first end of first, second and third connector sleeves, respectively, to first, second and third detonator caps, each said detonator cap having first and second electrical ignitor wires;

securing the first and second ignitor wires of said first detonator to one another and securing the first and second ignitor wires of said second detonator to one another to prevent accidental detonation thereof;

transporting said tubes, cable, wire and detonators with said detonators displaced separate containers from said tubes;

positioning said detonators adjacent to and in contact with the ends of said first, second and third tubes with said second and third detonators being positioned between said second and third tubes;

inserting adjacent ends of said second and third tubes into the other ends of said second and third connector sleeves with the ends of said tubes adjacent said second and third detonator caps, respectively;

attaching a second end of said first tube to a second end of said second tube, said attaching further defined by inserting a dampener element between said end of said first tube and said end of said second tube and within said second connector sleeve;

securing said first and second connector sleeves to said first and second tubes respectively;

inserting the end of said first tube into the other end of said third connector sleeve, and securing said first connector sleeve to said first connecting tube;

connecting the first and second igniter wires of said first detonator to said series connection terminals at said second connecting point;

disconnecting said first and second wires of said second and third detonators from each other and connecting such first wires to said series connection terminals at said first connection point;

connecting said second wires of said second and third detonators to each other, inserting said cable, electrical wire, tubes and detonators into a desired location within a well casing; and activating each of said detonators by electrically energizing said electrically conductive wire to thereby produce a series of outwardly directed pressure pulses within said well casing and effect cleaning of said casing.

12. The method of claim 11, wherein said sealing step further comprises the steps of:

applying a coating of non-drying sealant to said tube ends; and attaching an end cover over each said coated tube end.

13. The method of claim 12, wherein said attaching step of said sealing step comprises crimping said end covers to said tube ends in two adjacent locations.

14. An apparatus for cleaning a liquid well having a casing comprising:

first and second subassemblies, each said subassembly comprising:

a length of detonator cord, said cord further defined by an inner sheath and an outer sheath, said outer sheath applied directly over said inner sheath, and having a substantially uniform cross section and further containing combustible material having a deflagration rate many times greater than the velocity of sound in the liquid of the well;

means for igniting said combustible material to achieve deflagration of said material that progresses along the length of said cord and generates outwardly directed pressure;

a plurality of short high strength sleeves mutually spaced by distances many times greater than the length of said sleeves secured to the exterior of said cord for attenuating said outwardly directed pressure at short areas spaced along the length of said tube by relatively long distances;

a dampening element positioned between said first and second subassemblies in axial alignment with said lengths of detonator cord; and means for holding said cord in the casing of the well.

15. The apparatus of claim 14, further comprising:

a third said subassembly.

16. The apparatus of claim 15, wherein:

each said cord is further defined by a pair of opposing ends, one said end having an end cover attached thereto; and further comprising a non-dried coating of non-drying sealant between said ends and said end covers thereattached.

17. The apparatus of claim 16, wherein said end covers and said cords thereattached are defined by a pair of circumferentially crimped indentations.

18. The apparatus of claim 14, further comprising tabular blast shields, one said subassembly passing through an inner chamber defined by each said blast shield, said blast shield comprising a plurality of filaments in spaced relation along their length.

* * * * *